United States Patent [19]

Holland

[11] Patent Number: 4,757,761

[45] Date of Patent: Jul. 19, 1988

[54] WOOD GRAIN SIMULATING APPARATUS AND METHOD

[76] Inventor: Keith L. Holland, High Hartbarrow, Winster, Windermere, Cumbria LA23 3PA, United Kingdom

[21] Appl. No.: 28,606

[22] Filed: Mar. 20, 1987

[51] Int. Cl.[4] ..... B41K 1/24

[52] U.S. Cl. ..... 101/376

[58] Field of Search ..... 101/375, 376, 125, 328, 101/329, 330, 368, 372, 401

[56] References Cited

U.S. PATENT DOCUMENTS

| | | | |
|---|---|---|---|
| 39,953 | 9/1863 | Potter, et al. | 101/376 |
| 40,224 | 10/1863 | Adams | 101/376 |
| 149,098 | 3/1874 | Burns | 101/376 |
| 1,401,471 | 12/1921 | Hering | 101/368 X |
| 1,783,401 | 12/1930 | Brooks, Jr. et al. | 101/376 X |
| 1,974,486 | 9/1934 | Edwards et al. | 101/376 |
| 2,784,668 | 3/1957 | Poje | 101/368 X |

FOREIGN PATENT DOCUMENTS

| | | | |
|---|---|---|---|
| 245044 | 12/1925 | United Kingdom | 101/376 |
| 2164605 | 3/1986 | United Kingdom | 101/368 |

*Primary Examiner*—Clifford D. Crowder

[57] ABSTRACT

Wood grain simulating apparatus comprising a printing block having a plurality of contiguous curved surfaces (3,4,5) each with a pattern embossed thereon, adjacent surfaces meeting at outwardly pointing ridges (6,7).

10 Claims, 6 Drawing Sheets

WOOD GRAIN SIMULATING APPARATUS AND METHOD

This invention relates to apparatus for simulation of grain particularly but not exclusively to wood grain. The invention also relates to simulation of the appearance of marble or other materials having a grain like pattern. The invention also relates to a method of simulation of such grain or patterning.

Simulated wood grain is traditionally created upon panels, doors, walls or other surfaces by application of a transprent or semi-transparent decorative paint known as a scumble or glaze, which remains wet and mobile for a period after application to permit manipulation of the film with brushes, rags or combs to produce broken color effects resembling wood grain. The scumble is then left overnight to harden and a coat of varnish is applied. Creation of realistic grain with brushes and combs is a skilled operation beyond the capability of a do-it-yourself enthusiast.

The objects of the present invention are to provide apparatus and a method of use thereof which are amenable to use by an unskilled amateur.

According to a first aspect of the present invention a grain simulating apparatus comprises a printing block having a plurality of contiguous curved surfaces each with a pattern embossed thereon.

The patterns preferably simulate wood grain although patterns of lines may be employed which require brushing or wiping after application to create the appearance of grain. Patterns of knots, cracks or other features of wood panels may be employed.

The apparatus is particularly suited for use with rapid drying paint e.g. acrylic paint, although it may be employed for producing patterns under conventional scumble or glaze. The use of rapid drying paint allows a workpiece to be varinshed almost immediately afterwards, with a significant saving in time. In addition, mistakes can be easily rectified by wiping with a cloth or sponge.

The apparatus possesses advantages which are not conferred by use of an embossed roller since the cylindrical surface of the latter cannot print into corners but produces an undesirable regularly repeating pattern.

Adjacent curved surfaces are preferably joined at outwardly projecting ridges.

The patterns embossed on the contiguous surfaces adjacent a ridge are preferably the same so that a user may print a continuous pattern from the two surfaces without producing a discontinuity at the ridge.

More preferably the patterns adjacent each ridge of the block are the same or are convergent so that a user may print a continuous pattern using the surfaces in any convenient order. This also allows the surfaces to be reversed to vary the printed pattern.

A complementary set of apparatus may be provided.

A set of printing blocks may have patterns of different wood grains, for example oak, mahogany or other sap grains, figure grains, pure grains or feather grains. Different densities or thicknesses of patterns may be provided.

The blocks may be color coded or otherwise identified. Instructions for use of the apparatus may use color coding or other means of identification to show which printing blocks should be used on the various parts of a complex workpiece such as a panelled door.

A second aspect of this inventio provides a method of simulating wood grain by use of apparatus in accordance with the first aspect of the invention.

The invention is further described by means of example, and not in any limitative sense with reference to FIGS. 1 to 6 of the accompanying drawings, of which:

Figure 1:
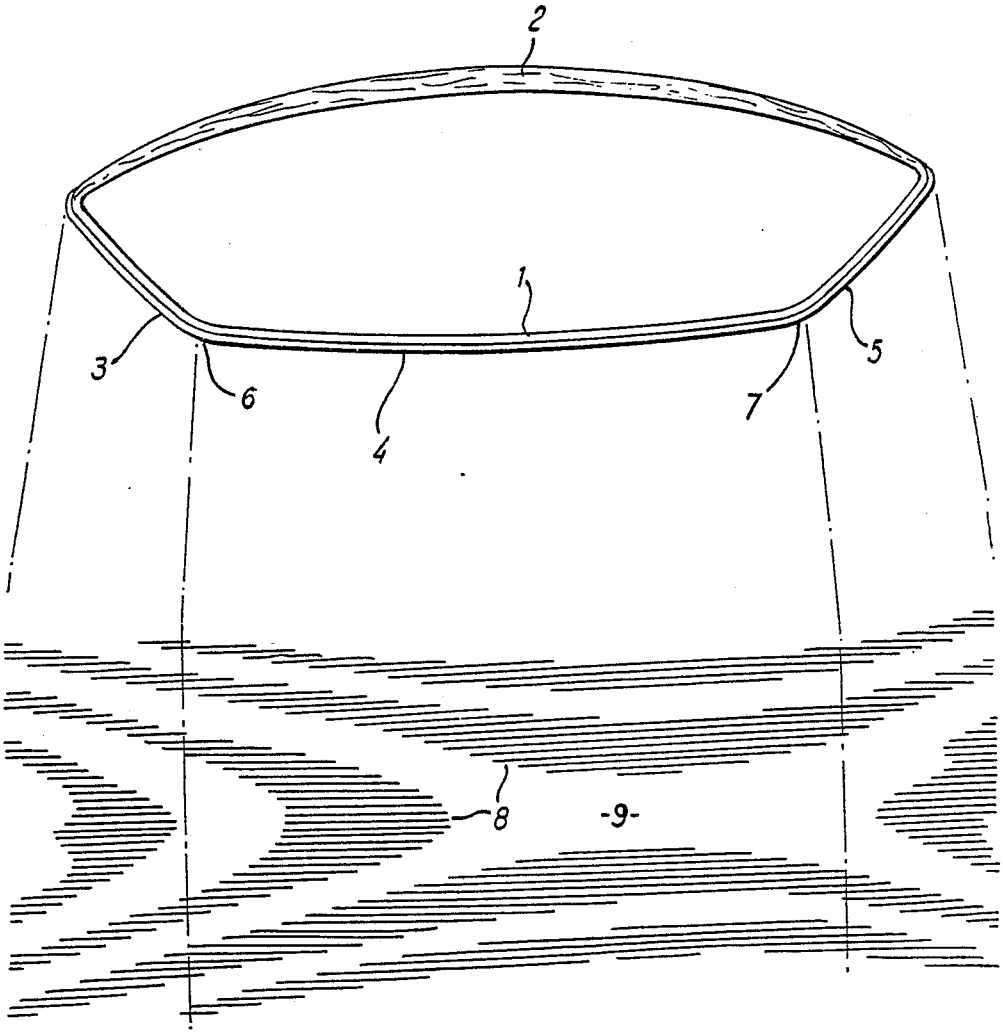
FIG. 1 is an elevation illustrating apparatus in accordance with this invention with a development showing the embossed surfaces.
Figure 2:
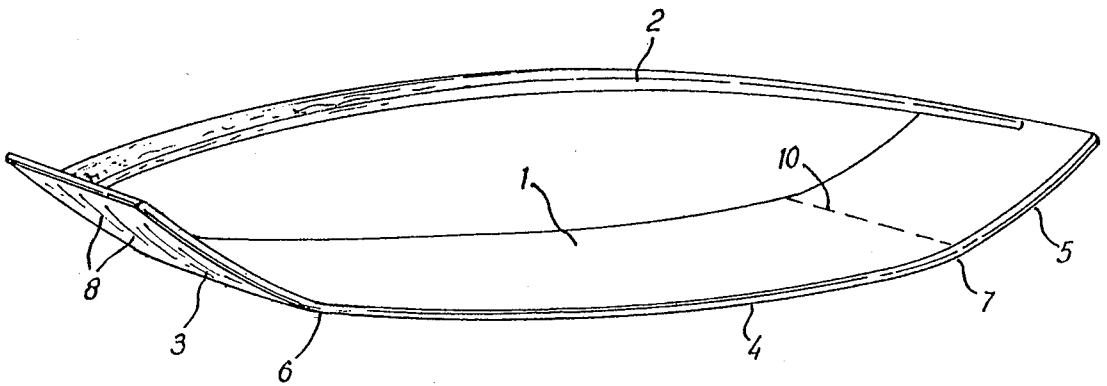
FIG. 2 is a perspective view of the apparatus.

FIGS. 1 and 2 show an apparatus in accordance with this invention comprising a printing block 1 and a handle 2. The printing block has three contiguous curved surfaces, 3,4,5 joined at outwardly projecting ridges 6,7. The surfaces 3,4,5 each have an embossed pattern formed from generally parallel ridges 8 as shown in the development of the curved surfaces 9. The patterns of adjacent surfaces e.g. 3,4 are the same where they join at the ridge 6. The pattern may develop continuously from one surface to another as shown in FIG. 1. The rear surface of the block 1 is provided with markings 10 each corresponding to the location of the ridge 7 on the opposite surface.

Figure 3A:
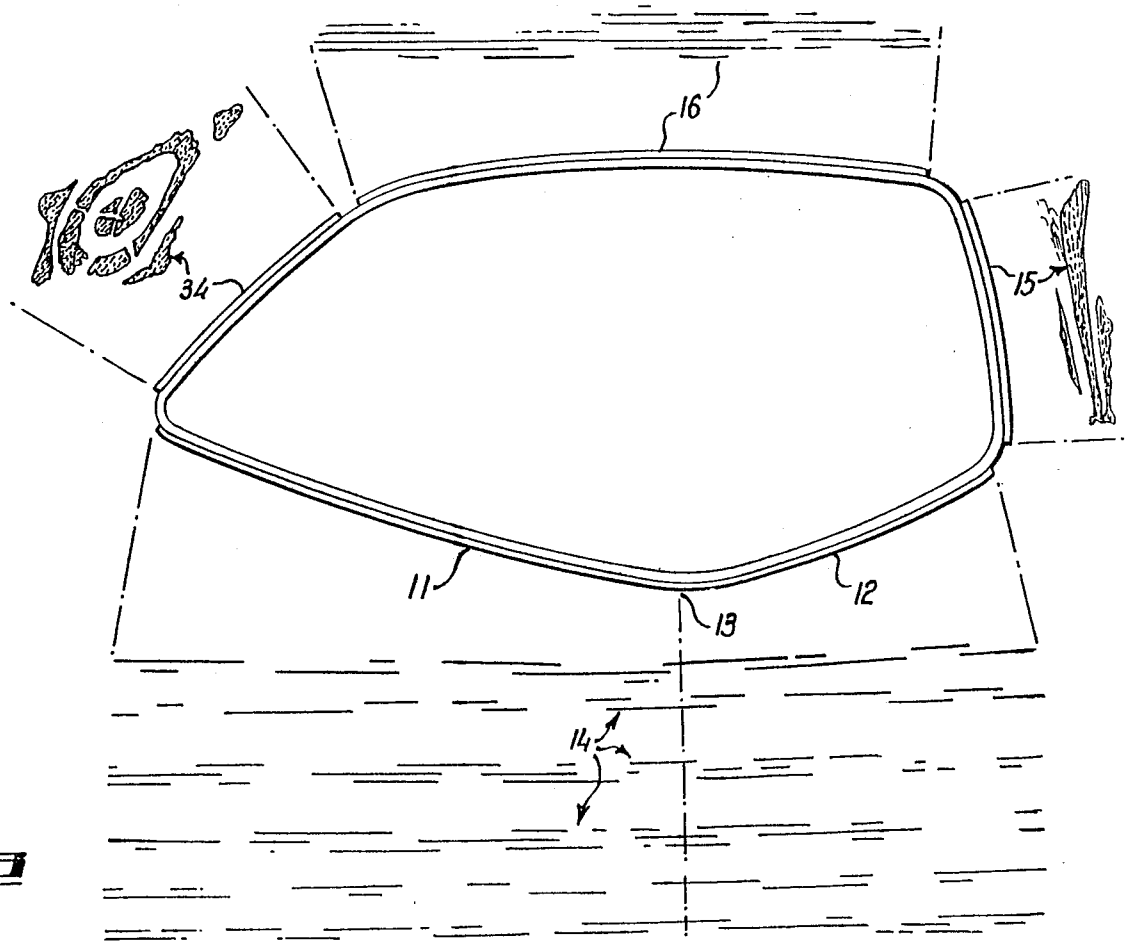
FIG. 3 is an elevation showing an alternative apparatus together with developments of the embossed surfaces.

FIG. 3 shows an alternative apparatus which is generally similar in construction to that shown in FIGS. 1 and 2. There are five printing block surfaces, two of which 11,12 adjoin at an outwardly projecting ridge 13. The surfaces 11,12 are embossed with perforated lines 14 which may be used to simulate the appearance of pore grains.

End surfaces 34,15 are embossed with patterns of knots and the handle 16 is embossed with a narrow pore grain pattern.

Figure 4:
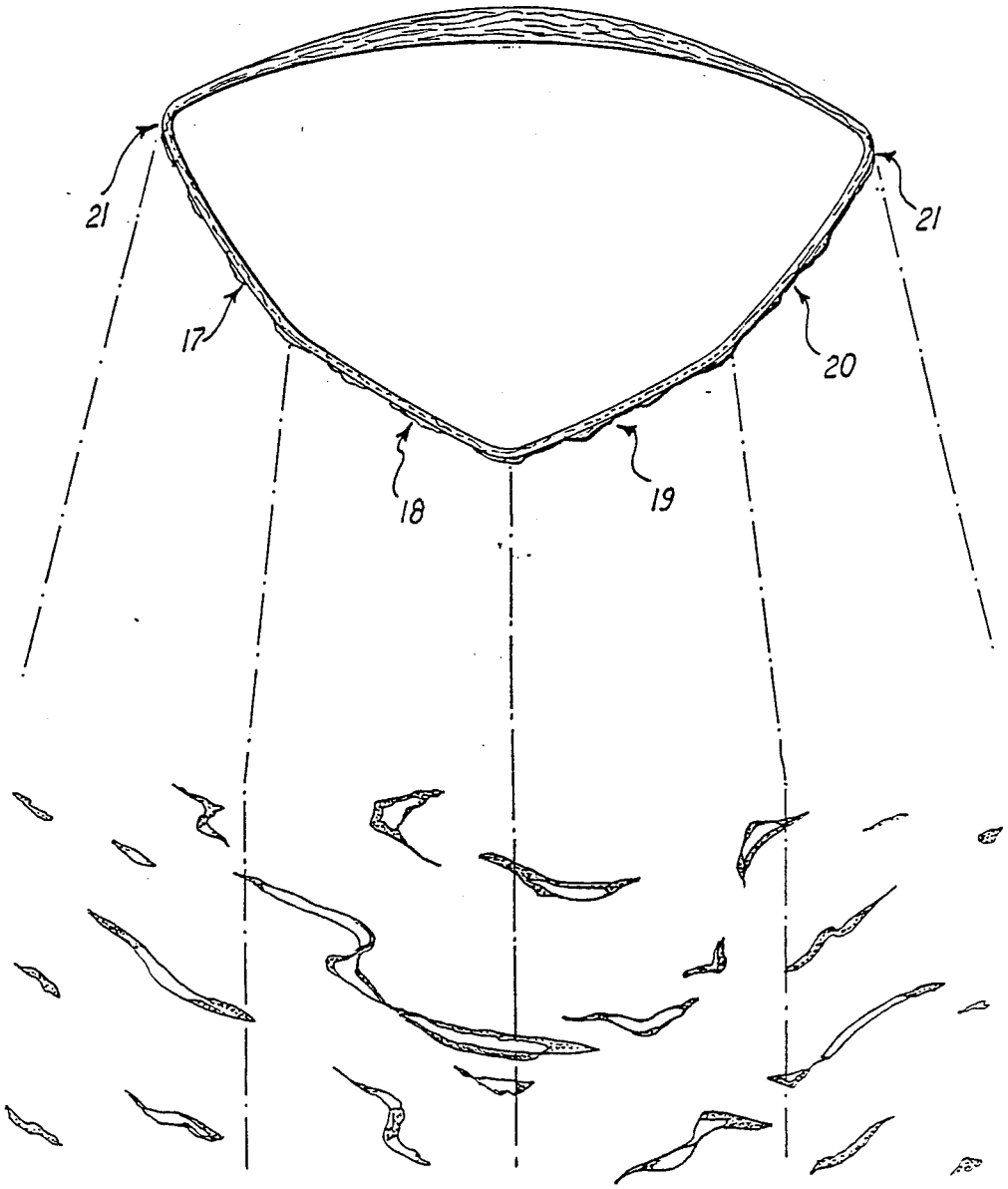
FIG. 4 is an elevation of a further alternative apparatus together with developments of the embossed surfaces.

FIG. 4 shows a further alternative apparatus having four consecutively contiguous surfaces 17–20 which are embossed with a figure grain pattern. The figure grain pattern may be applied loosely, at any angle. The pattern is preferably overprinted with a pore grain.

The leading and trailing edges of the surfaces e.g. 21 of the FIG. 4 embodiment of each apparatus are arranged at an angle of not more than 90° to the handle to facilitate printing into corners or other confined spaces.

Each printing block may be colour coded or otherwise marked to facilitate use in conjunction with a set of instructions. For example, a plan of a panelled door may have the muntins, eye rails, lockrail, stiles etc., identified with colours corresponding to the printing blocks to be used for graining of those parts.

Use of a set of apparatus comprising the individual apparatus shown in the FIGS. 1 to 4 is illustrated with reference to the simulated pattern shown in FIG. 5.

A surface upon which it is desired to simulate the appearance of wood grain may be primed beforehand if desired.

The apparatus shown in FIGS. 1 and 2 may be used to create a continuous, non-repetitive sap grain effect, for example upon fascia panels or flush doors. A pad soaked in acrylic or other paint is applied to the embossed surfaces 3, 4, 5. Patterns may be applied to the desired surface by a rolling action of any of the surfaces 3,4,5, for example as shown at 22 on FIG. 5. The apparatus may be reversed or the order of application of the surfaces 3,4,5 may be varied to avoid production of a repetitive pattern. Brushing of the printed pattern before the paint dries may produce a more realistic, darker effect. Brushing may also serve to conceal any discontinuities in the printed pattern.

Figure 5:
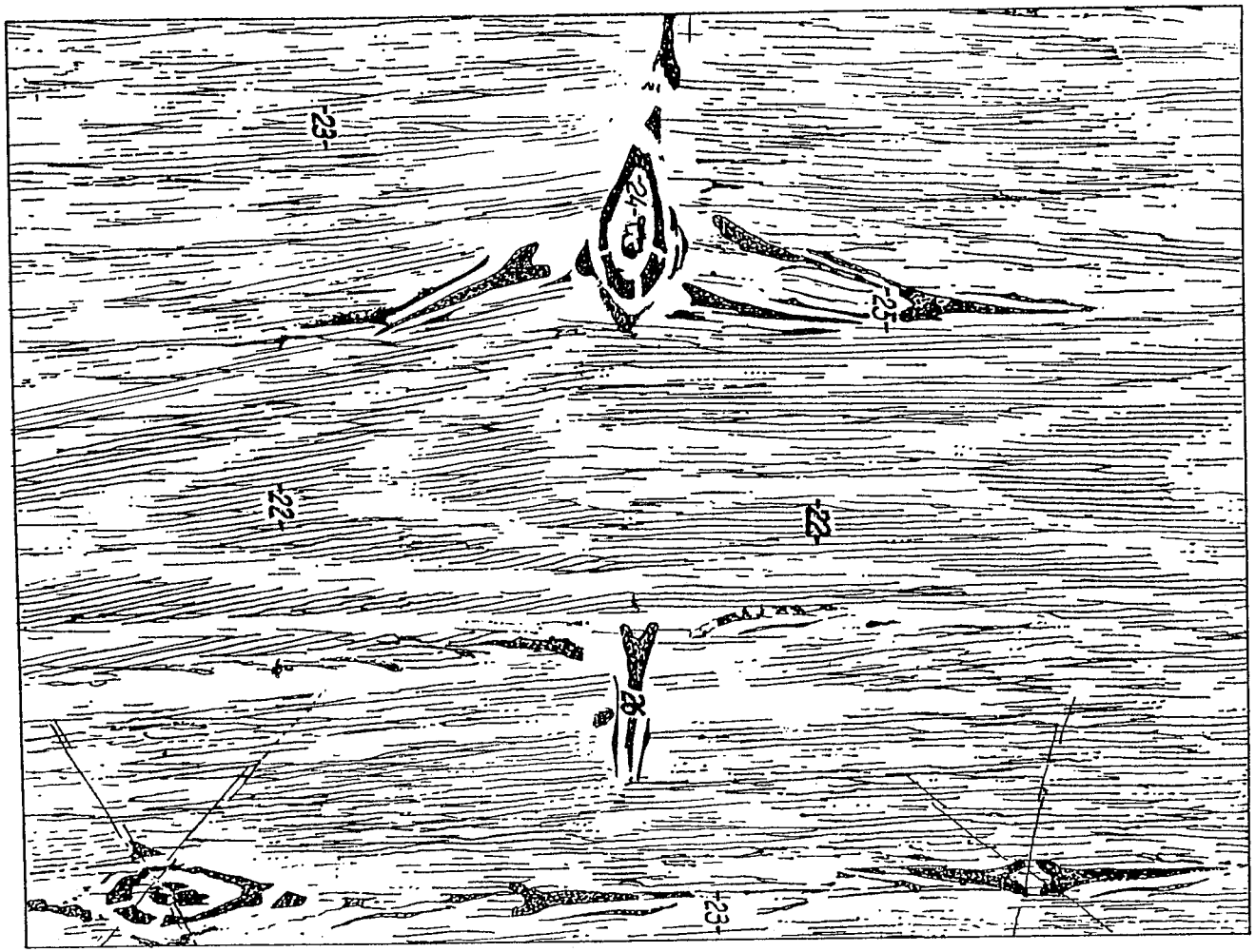
FIG. 5 shows a simulated wood grain produced using the apparatus shown in FIGS. 1 to 3.

The apparatus shown in FIG. 3 is used to simulate pore grain and may be applied over the sap grain pattern, as shown at 23 on FIG. 5.

Alternatively the apparatus may be used alone to produce a plain wooden effect. The pore grain pattern, applied in the manner described above, may be brushed to produce a deeper lined effect. The narrow pore grain surface 16 may be used for edges or in narrow spaces. Knots may be printed as shown at 24 using the embossed surface 34. The embossed surface 15 serves to extend the knots as shown at 25. In addition the printed knots may conceal discontinuities in the pattern as at 26.

Figure 6:
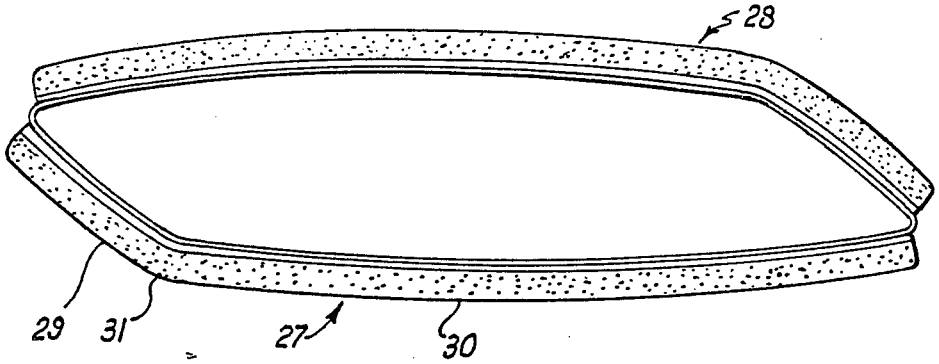
FIG. 6 is an elevation of a further alternative apparatus together with developments of the embossed surfaces.
Figure 6:
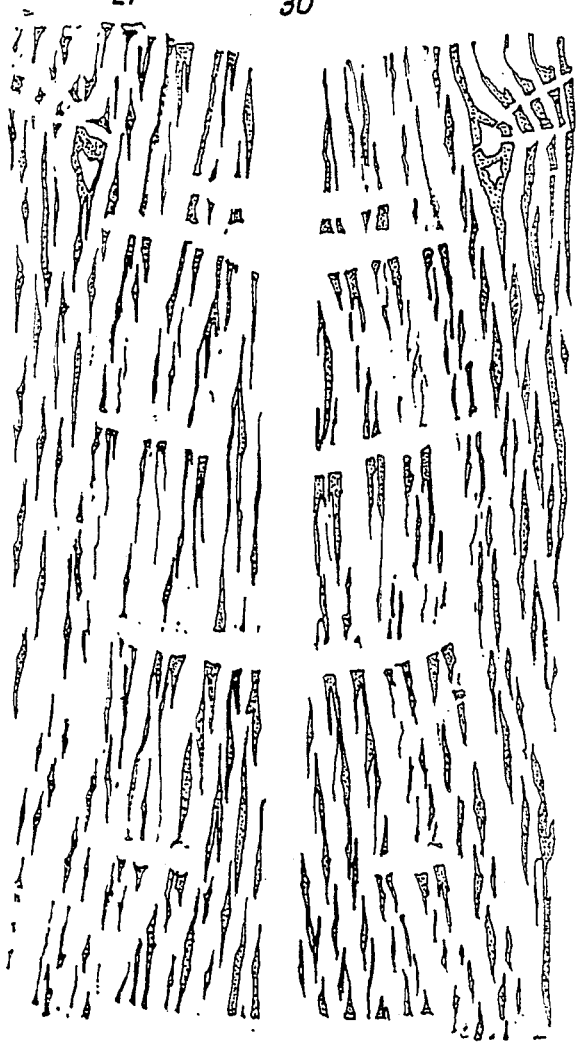

FIG. 6 shows a further preferred embodiment of this invention. The apparatus is provided with two printing blocks 27,28 each having two surfaces e.g. 29,30 joined at an outwardly projecting ridge 31. The apparatus has a generally tubular form with the embossed surfaces 29,30 etc., forming the outside of the tube. The lower part of FIG. 6 shows a development of the two printing blocks. The patterns thereon represent wood grain inclined at an angle to the length of the blocks.

The pattern of the first block 27 is inclined clockwise and the pattern of the second block 28 is inclined anticlockwise. These patterns may be applied to a workpiece to create the impression of inclined grain. The direction of inclination may be reversed across the length or width of the workpiece. The pattern may be overprinted, brushed or combed after application as desired, but this is not usually necessary.

A printing block may be provided having a generally similar pattern to that shown in FIG. 6 but not inclined. This may be used in conjunction with the inclined pattern to produce a wide variety of effects. Printing surfaces of preferred apparatus are provided as disposable belt-like or strip-shaped members which may be discarded after use on several occasions, or when the pattern applied is sought to be changed. The surfaces which may be composed of foamed plastics, paper or other materials may be fastened to supports by clips or adhesives. For example a hand grip may be formed from two interlocking portions between which edges of a strip shaped member may be secured.

Scumble coatings dry rapidly, particularly in warm environments.

Use of the present invention has the additional advantage over the oil scumble method that there is no need to work rapidly before the scumble dries. However, the invention may be used in conjunction with a scumble coat to provide a combination of effects, the scumble coats being applied over the printed surface and then wiped off to partially expose the printed pattern.

I claim:

1. Grain simulating apparatus comprising: a printing block having at least two outwardly curved printing surfaces contiguous along one edge thereof; a linear ridge formed along a line of contiguity between said printing surfaces, each printing surface being embossed with a different grain simulating pattern, the patterns matching at said ridge, at least one of said printing surfaces being positionable to contact the edge of a surface to be grained which abuts against another surface at an angle thereto.

2. Apparatus as in claim 1, wherein said patterns are parts of a single pattern.

3. Apparatus as in claim 1, wherein said patterns are different patterns having a portion at said ridge which corresponds with a portion of the other pattern at said ridge.

4. Apparatus as in claim 1 having a handle spaced from said surfaces.

5. Apparatus as set forth in claim 1, wherein said surfaces are a major surface and a minor surface, the major surface being longer than said minor surface.

6. Apparatus as in claim 1, wherein said surfaces are formed on panels detachably secured to the apparatus.

7. Apparatus as in claim 1, wherein there are more than two surfaces, each said additional surface being outwardly convex, bearing a grain-simulating embossed pattern, and being contiguous at a ridge with at least one other embossed surface.

8. Apparatus as in claim 7, wherein each surface has a pattern which matches that surface with which it is contiguous at a ridge.

9. Apparatus as in claim 7, wherein each surface has a pattern which is different from but complementary to the pattern on one of said other surfaces.

10. A method of imprinting a graining pattern on a surface to be grained when the surface is at a corner, said method comprising the steps of using a tool having a first convexly curved printing surface and at least one additional convex printing surface contiguous with said first printing surface and meeting the first printing surface at an outer ridge, with an angle between the printing surfaces less than the angle between the surface to be grained and any surface adjacent thereto, the first printing surface having a first graining pattern thereon, and the second printing surface having a second graining pattern thereon, the two patterns matching where they meet at said ridge, the method including the steps of: preparing the surface to be grained for imprinting; positioning the edge of one of the printing surfaces in contact with the surface to be grained; rolling this positioned printing surface along the surface to be grained until the other edge of said printing surface contacts the surface to be printed; and then raising the tool from the surface to be printed.

* * * * *